US005964072A

United States Patent [19]

Rasmussen

[11] Patent Number: 5,964,072

[45] Date of Patent: Oct. 12, 1999

[54] CONSTRUCTION FRAMEWORK WITH INTERCROSSING BEAMS

[76] Inventor: Gunnar Vestergaard Rasmussen, Vængemosevej 13, DK-5881 Skårup, Denmark

[21] Appl. No.: 09/043,924

[22] PCT Filed: Oct. 9, 1996

[86] PCT No.: PCT/DK96/00427

§ 371 Date: Apr. 9, 1999

§ 102(e) Date: Apr. 9, 1998

[87] PCT Pub. No.: WO97/13932

PCT Pub. Date: Apr. 17, 1997

[30] Foreign Application Priority Data

Oct. 9, 1995 [DK] Denmark ..... 1129

[51] Int. Cl.[6] ..... E04C 2/42

[52] U.S. Cl. ..... 52/666; 52/668; 52/736.2; 52/732.2

[58] Field of Search ..... 52/736.2, 666, 52/668; 403/347, 346, 354, 400

[56] References Cited

U.S. PATENT DOCUMENTS

| | | | |
|---|---|---|---|
| 1,497,516 | 6/1924 | Lane | 403/346 |
| 1,972,309 | 9/1934 | Mcmurchy | 403/346 |
| 1,985,150 | 12/1934 | Collins | 403/346 |
| 2,097,172 | 10/1937 | Yurkovitch | 403/346 |
| 3,310,922 | 3/1967 | Hoffmann, Jr. | 403/346 |
| 3,768,224 | 10/1973 | Curtis | 403/346 |
| 3,875,712 | 4/1975 | Thompson . | |
| 3,927,950 | 12/1975 | Herrmann et al. | 403/346 |
| 5,285,612 | 2/1994 | Johnson | 403/346 |

FOREIGN PATENT DOCUMENTS

| | | |
|---|---|---|
| 0 424 560 | 5/1991 | European Pat. Off. . |
| 967389 | 8/1964 | United Kingdom . |
| 1298723 | 12/1972 | United Kingdom . |

*Primary Examiner*—Carl D. Friedman
*Assistant Examiner*—Dennis L. Dorsey
*Attorney, Agent, or Firm*—Sixbey, Friedman, Leedom & Ferguson; David S. Safran

[57] ABSTRACT

A framework construction, e.g. for buildings, is made with intercrossing beams (2, 4, 4') of profiled plate material, the beams being prepared with side incisions (14) enabling them to be joined crosswise in a common plane.

14 Claims, 7 Drawing Sheets

Fig.1
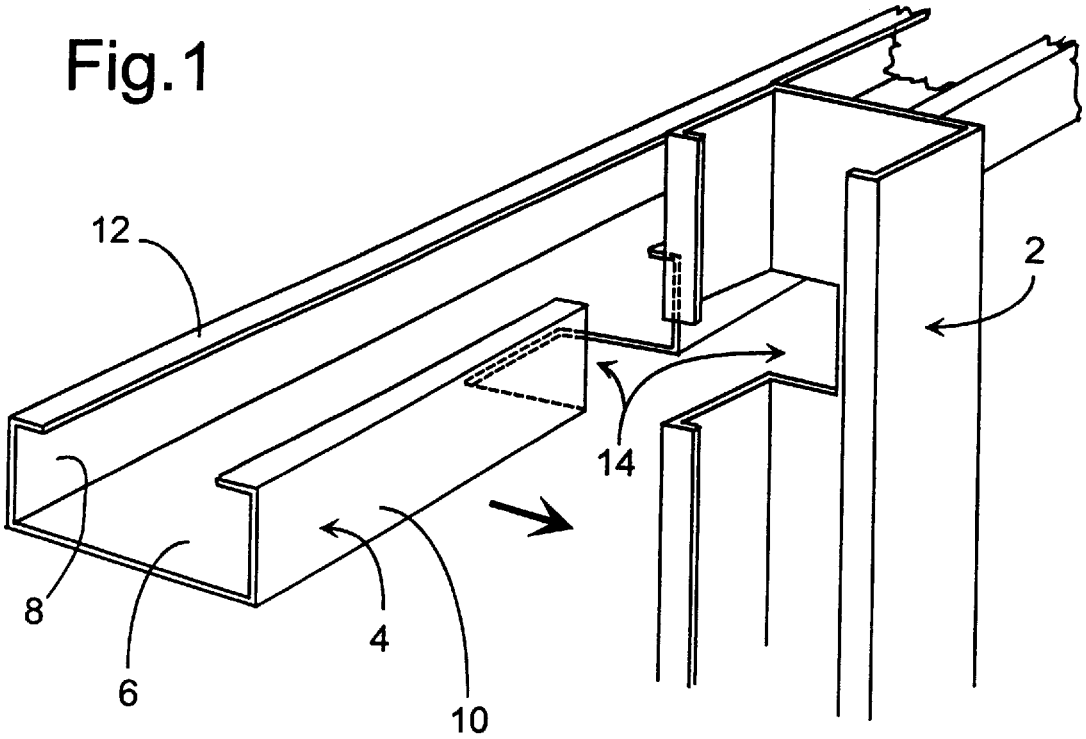
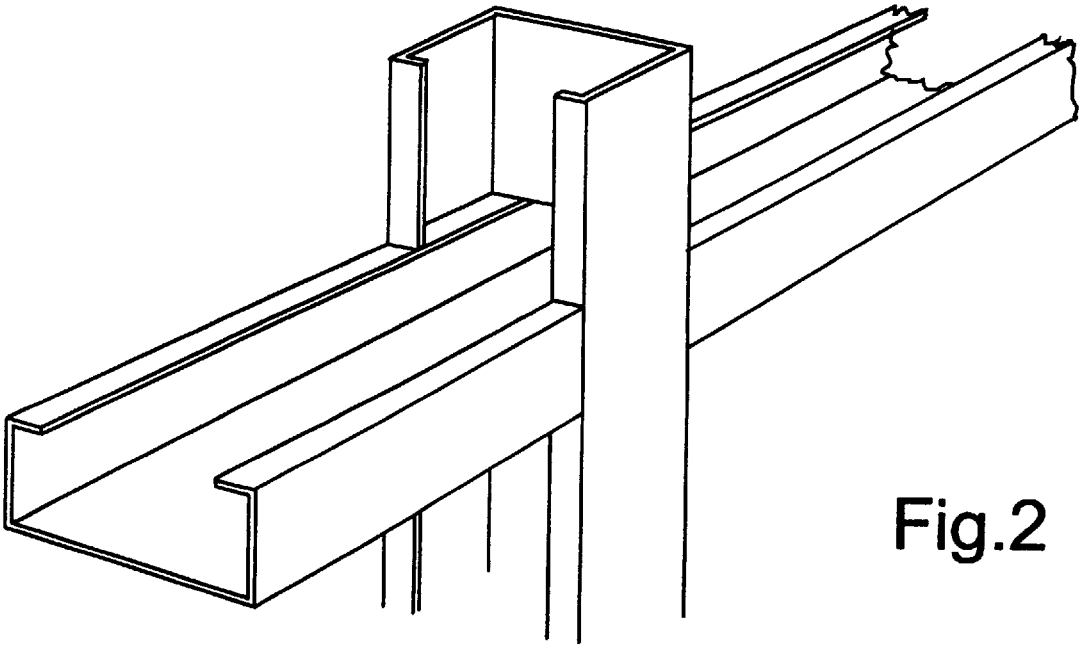
Fig.2

Fig.3
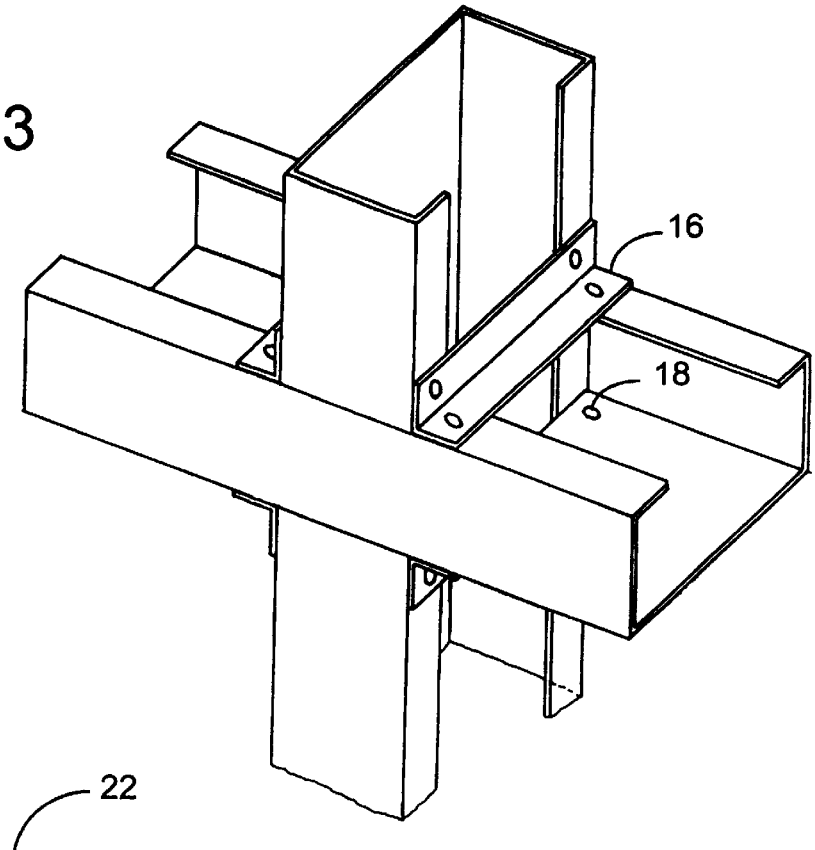
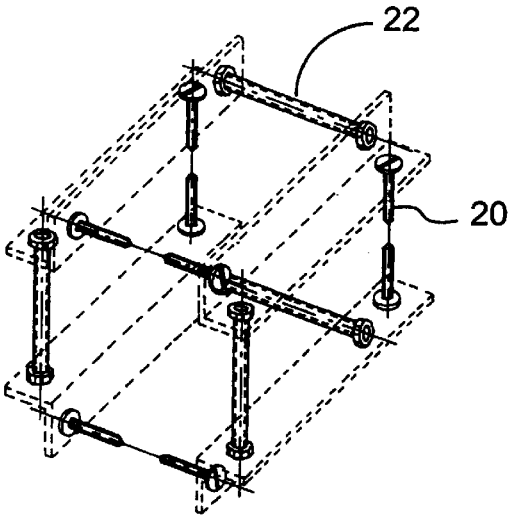
Fig.4
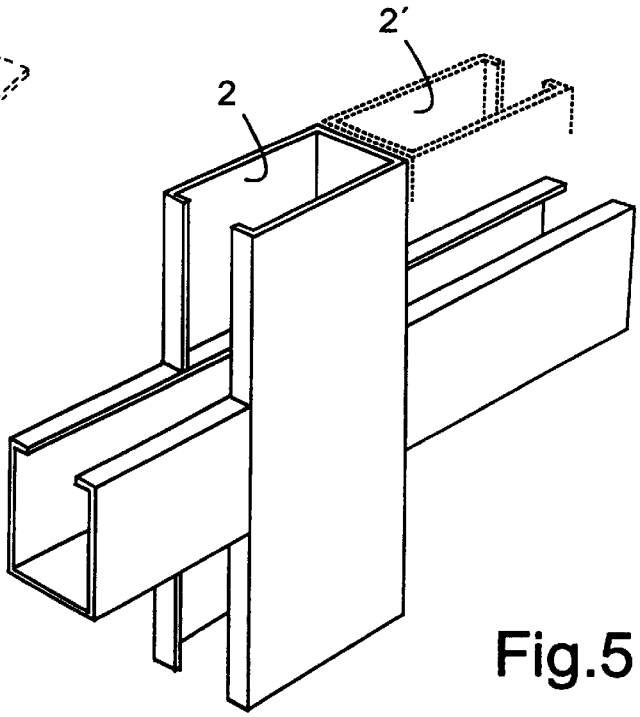
Fig.5

Fig.12
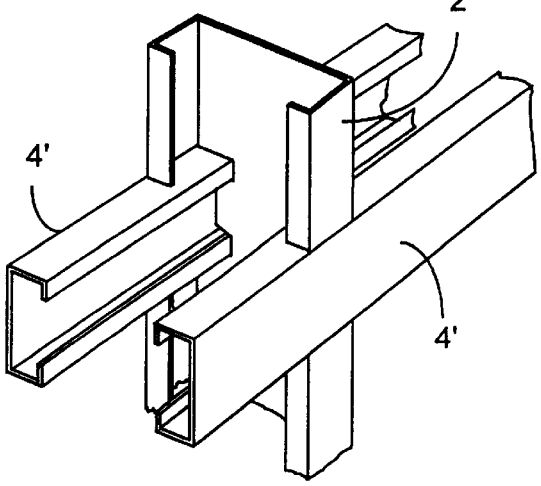
Fig.13
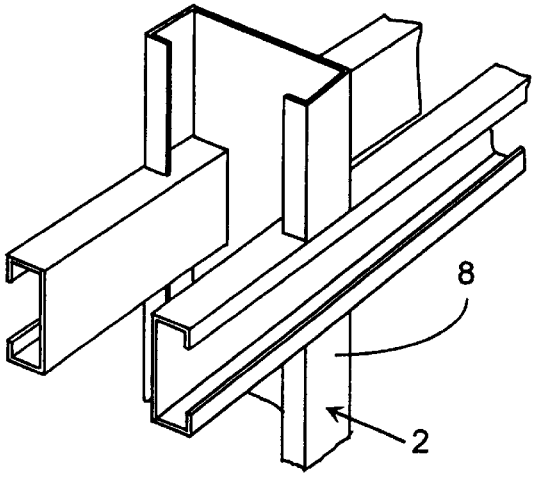
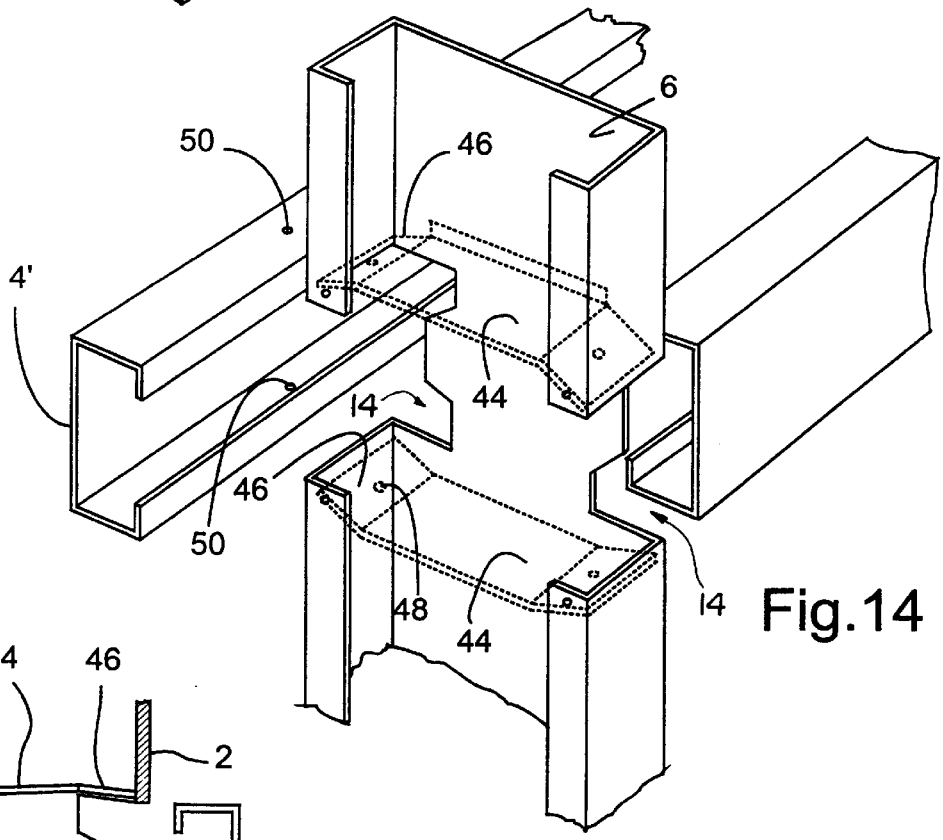
Fig.14
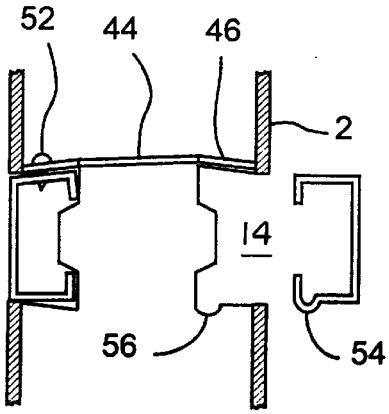
Fig.15

CONSTRUCTION FRAMEWORK WITH INTERCROSSING BEAMS

The present invention relates to a construction framework with intercrossing beams such as columns and girders. The invention is primarily linked with building constructions of all types, but is not correspondingly limited, as relevant frameworks do appear also in machinery constructions and elsewhere.

The invention is based on the consideration that a strong and relatively light framework can be provided by means of C-profiled beams, preferably but not exclusively made of metal plate material, and that it is possible to prepare such beams with side recesses enabling them to be cross joined in the same plane without undue weakening in the crossing area. When the recesses are made with tight fit it is achievable that the cut-away web portions of the side flanges are substituted by the complementary web parts of the crossing beams so that pressure forces can be transferred as before, and the beams are easy to interconnect at the joints so that also pulling forces are transferable through the complementary web parts, e.g. in connection with bending impacts giving rise to a break momentum in the common plane of the crossing beams.

The crossing of the C-profiled beams in a common plane is advantageous in particular where the framework is to be filled out or covered with a panel plating, as in building or cabinet constructions.

Any relevant expert will know of different practical possibilities of application of such frameworks and also how to adapt them as to sizing, material choice and preparation with respect to additional details such as standard location of the crossing places along any beam for specific purposes, so it is deemed superfluous in the present connection to provide for detailed examples. They may range anywhere between small lightweight structures and high houses.

In the following the invention is described in more detail with reference to the drawings, in which:

FIGS. 1 and 2 are perspective views of two intercrossing, C-profiled beams, shown before and after joining, respectively;

FIG. 3 is a perspective view of a similar joint with added fixation means;

FIG. 4 is a perspective view of a relevant fixation system;

FIG. 5 is a perspective view of an intersection of beams of other dimensions;

FIGS. 12 and 13 are perspective views of modified joints;

FIG. 14 is an exploded view of the joint shown in FIG. 12;

FIG. 15 is a cross sectional view thereof;

Figure 7:
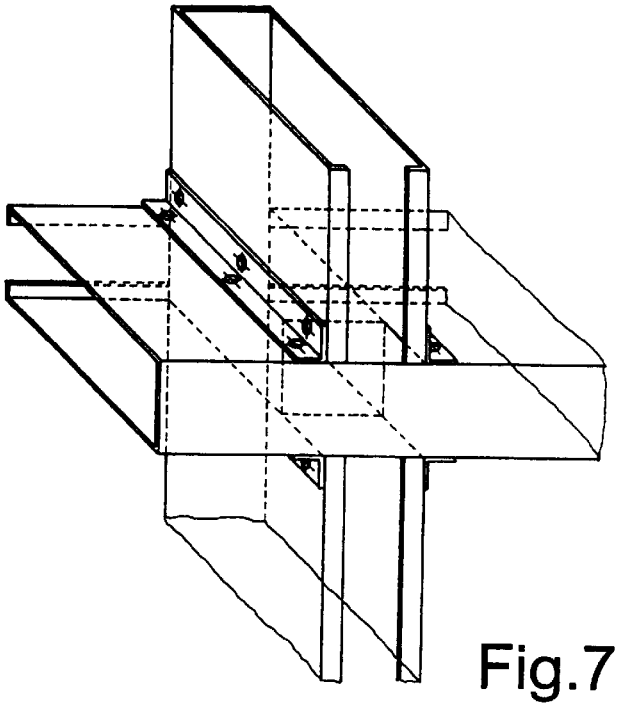
FIGS. 6 and 7 are perspective views of a modified beam system, seen before and after the joining, respectively.

In FIG. 1, the drawing shows a basic arrangement comprising a vertical beam 2 and a horizontal beam 4, each in the shape of a C-profiled plate element with a base wall 6, side walls 8 and 10, and inwardly projecting flanges 12 at the free edges thereof.

At communicating places these beams are provided with interfacing incisions 14 so as to be joinable by lateral insertion to the shape shown in FIG. 2. Both the beams and the incisions should be made with good accuracy, as it is then possible to achieve a cross joint with a remarkable stability already by the mere insertion.

However, as shown by an example in FIG. 3 it is preferred to effect a further fixation and stabilisation by means of angular plate fittings 16 having holes at opposite ends for receiving rivets or screws. The beams may be prepared with relevant holes 18 in situ or preferably as a standard in connection with the making of the incisions 14. Short, self-cutting screws can be used.

For further stability, however, a stay bolt and distance bushing system 20,22 as indicated in FIG. 4 may be used between all or some of the respective pairs of opposite holes, all according to the requirements.

FIG. 5 shows as an example that two crossing beams of equal thickness may well have different widths.

Figure 6:
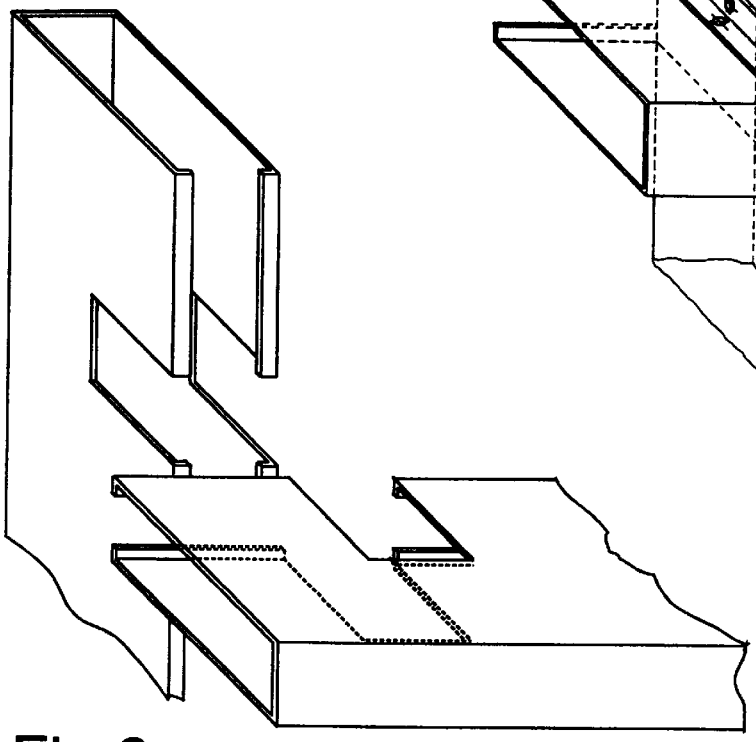

FIGS. 6 and 7 correspond to FIGS. 1 and 2, with the exception that the edge notches 14 are now provided in a symmetrical manner, inwardly from the edge flanges 12 in both of the broad sides 4 and 8. The corner lines are relatively long, so it may be desirable to use more than two screws in the corner plates 16, e.g. three as shown in FIG. 7.

Figure 8:
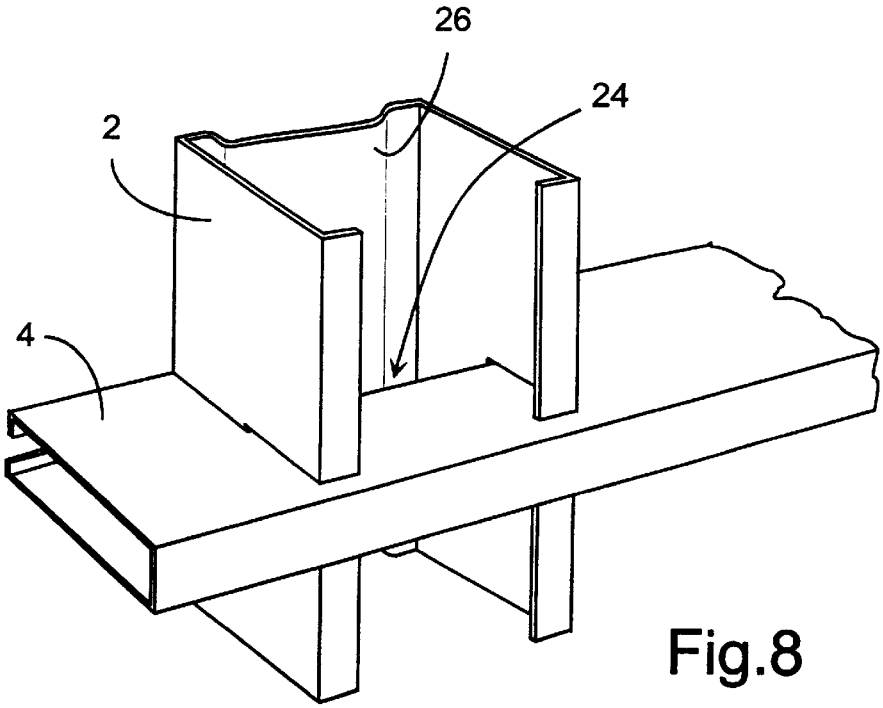
FIG. 8 is a view corresponding to FIG. 7, with other beam dimensions.

In FIG. 8 is shown an embodiment fully corresponding to FIG. 7, only with increased width of the vertical beam 2. Also, FIG. 8 shows a detail which is or may be a general feature of the framework, i.e., that in the crossing area there may be left a throughpassage 24 in each of the beams if the notches 14 are left fully open. These beams, therefore, are well suited for housing cables and pipes, which may even change direction in the crossing, because the throughpassages in the two beams are open towards each other. As another consequence of the space in these passages it is a possibility to use beams having a reinforcing countersunk profilation on or in the wall next to the said space, as shown at 26 in FIG. 8.

Figure 9:
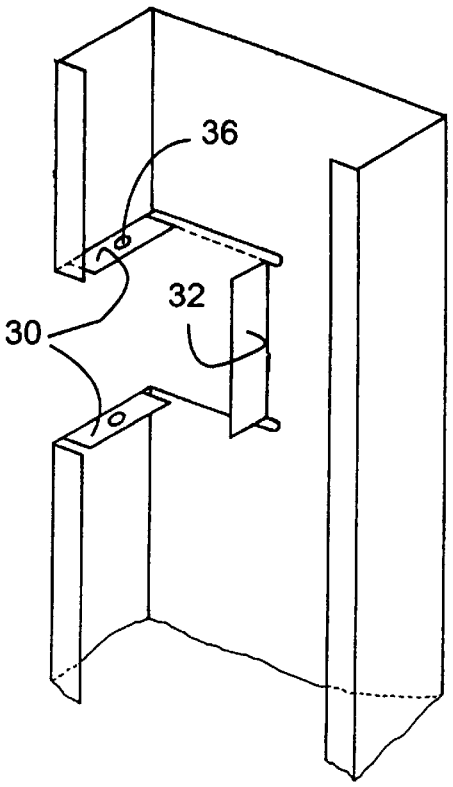
FIGS. 9–11 are perspective views showing further details.
Figure 10:
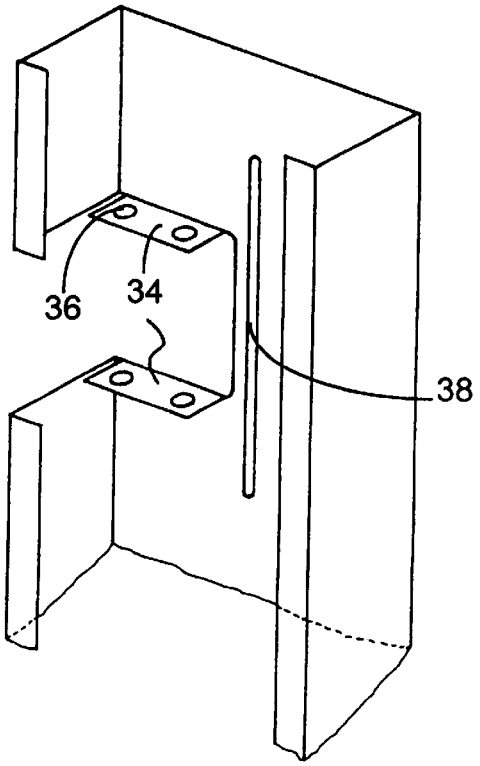

In FIG. 9, the C-profile is shown shaped with flaps 30 and 32 consisting of some of the material that would otherwise be removed by the shaping of the full notches 14. It will be readily understood that these flaps will have a stabilising effect. The flaps are shown bent inwardly, but they could as well be bent outwardly. Another arrangement of flaps 34 is shown in FIG. 10. As indicated the flaps may be provided with holes 36 enabling for screw connection with the other beam. FIG. 10 also shows a linear depression 38 in the rear wall of the profile.

Figure 11:
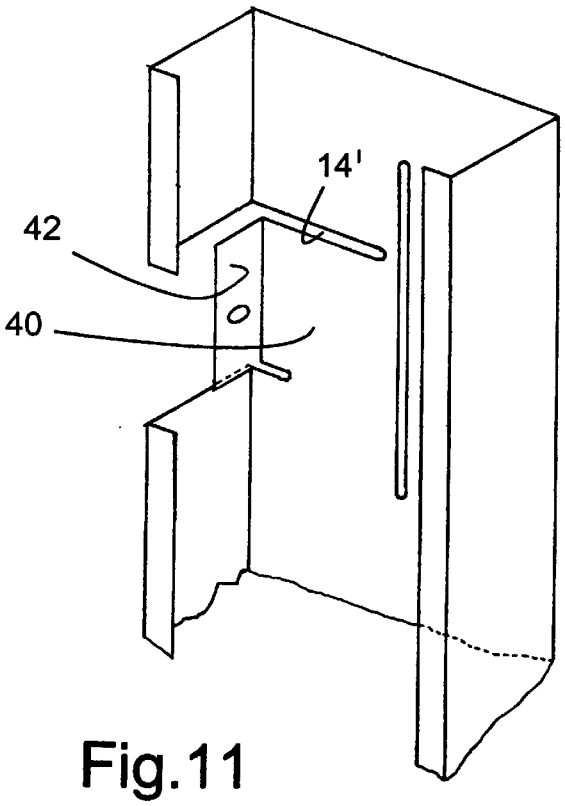

In FIG. 11 the notch 14 is changed into two slots 14', as sufficient for the reception of the crossing beam. The remaining panel portion 40 is provided with a flap 42 next to the side of the beam, enabling a screw connection with the relevant side of the crossing beam. This element, however, requires a cross beam 4 with full notches 14 as in FIG. 1.

It is not directly a condition that the crossing beams should be equally thick. Thus FIG. 8 shows that the horizontal beam 4 at the front side has a thickness dimension slightly larger than that of the beam 2, but it could also be smaller; the same may apply also to the other side, should such be wanted. It should of course, then, be taken into account how this may influence the strength of the joint.

Generally, the joints should preferably be designed so as to be symmetrical, seen as a whole, but they should not necessarily consist of only two beams. Thus, in FIG. 5 it is indicated that the beam 2 may be supplemented by a further beam 2', and so may the beam 4.

As shown in FIGS. 12 and 13, the system may also be modified so that one beam co-operates with separate beams at either side, here with the use of side notches in the singular beam only. Thus, the opposed horizontal beams 4' may extend unbroken across the vertical beam(s) 2, having their side opening facing inwardly (FIG. 12) or outwardly (FIG. 13).

The embodiment of FIG. 12 is shown in the partly exploded view of FIG. 14, which shows the double sided notches 14 in the beam 2, suggesting that the rear beam wall may have centrally protruding wing portions at the middle area of the notches. It is also suggested—in dotted lines—that at the junction, above and below the two horizontal beams 4', there is arranged a cross plate member 44 inside the beam 2, these plate members having outer end portions 46 that are bent downwardly and upwardly, respectively, and are provided with screw holes 48. Also the upper and lower side walls 8 of the beams 4' are provided with complementary screw holes 50, such that after the insertion of the beams 4' these holes 48 and 50 can be screw connected for general stabilisation of the joint.

However, as further shown in FIG. 15, it is a relevant possibility that the opposed side edges of the notches 14 in the rear beam wall 6 can be inwardly diverging, whereby it is particularly important that the inclined outer portions 46 of the cross plates 44 can be used for dragging out the side faces of the beams 4' against the notch side edges by mans of screws 52 through the holes 48 and 50 for a very efficient anchoring of the beams 4'.

At the bottom in the right hand side of FIG. 15 a modification is shown, where the side wall of the beam 4' is profiled or locally provided with a bead 54 near its free end, while the notch in the beam 2 has a corresponding edge incision 56. Thus, a locking engagement is also here achievable by dragging the beam 54 into the incision 56 by means of a cross plate 44,46.

Figure 16:
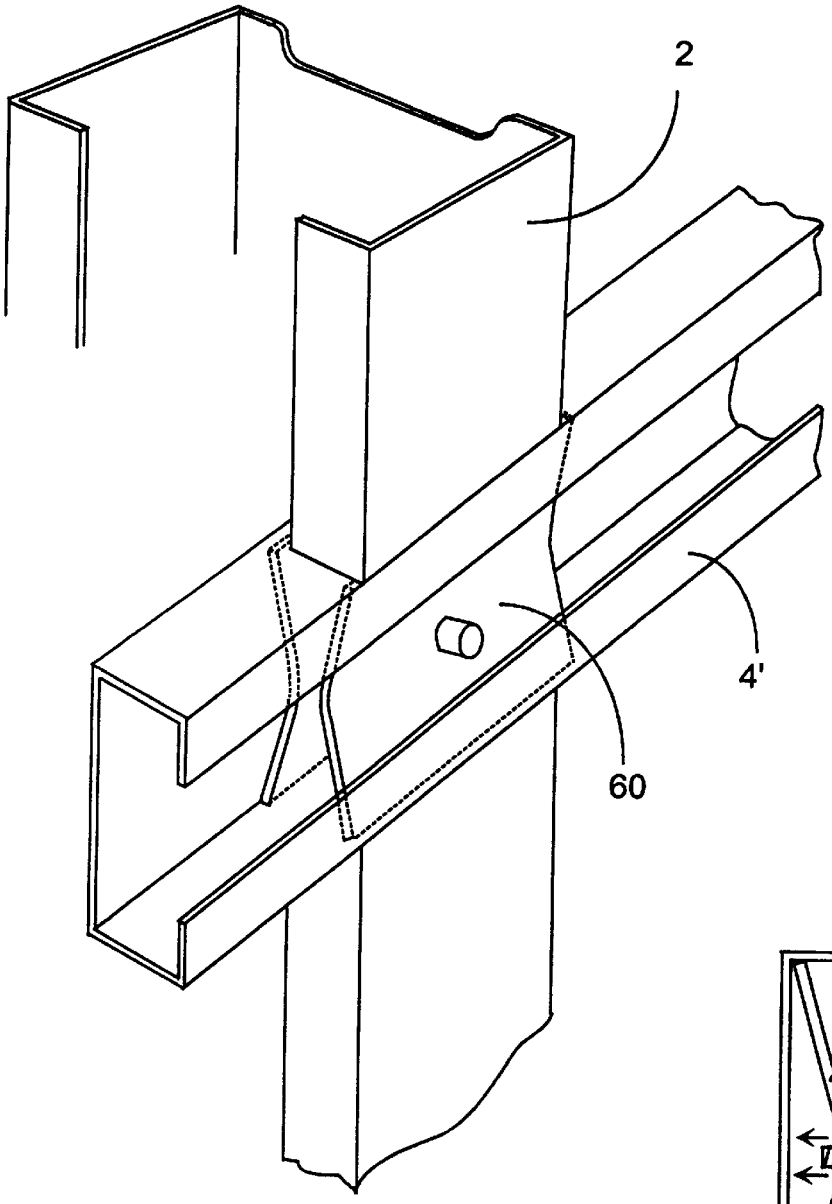
FIG. 16 is a perspective view of a joint as shown in FIG. 13.
Figure 17:
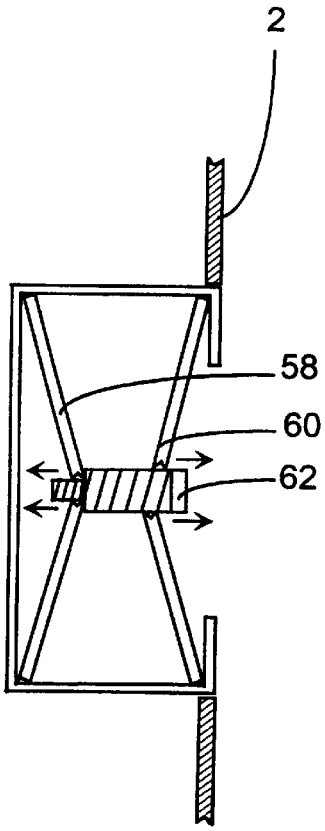
FIG. 17 is an end view thereof.

The joint shown in FIG. 13 implies that the side webs 8 and 10 of the vertical beam 2 are not directly continued across the side notches 14, but his can be remedied as shown in FIGS. 16 and 17. Inside the beam 4' is placed a reinforcement structure comprising two opposed, V-bent plate pieces 58,60 connected by a central screw member 62 which steps on the inner plate 58 and is in threaded connection with the outer plate 60. By operating the screw 62 the two plates can be pushed apart, whereby they will be more or less straightened out so as to press firmly up and down against the inner corners of the beam 4' and thus effectively stabilise the shape of the outwardly open beam 4'.

Figure 18:
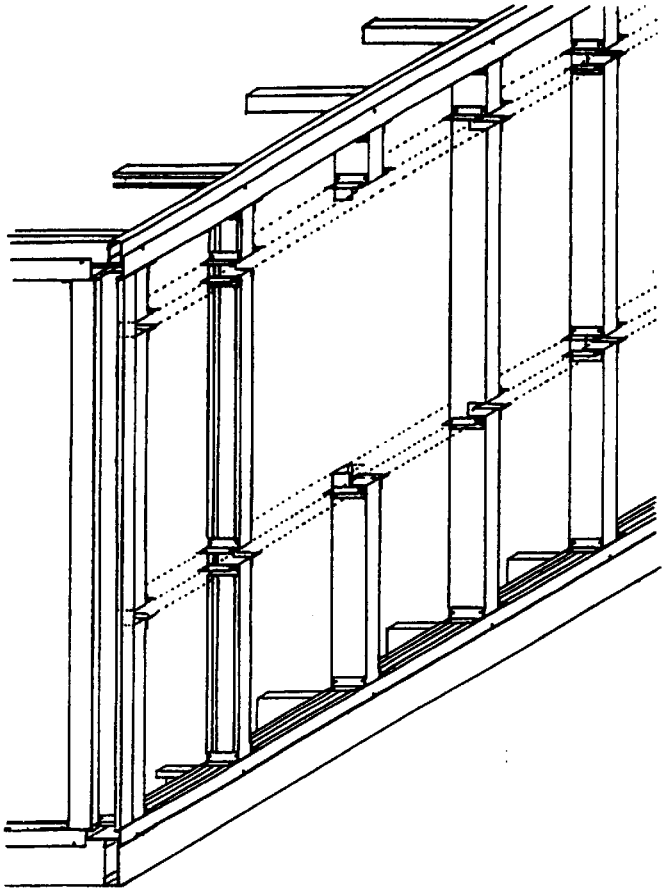
FIG. 18 is a perspective view of a house wall framework.
Figure 19:
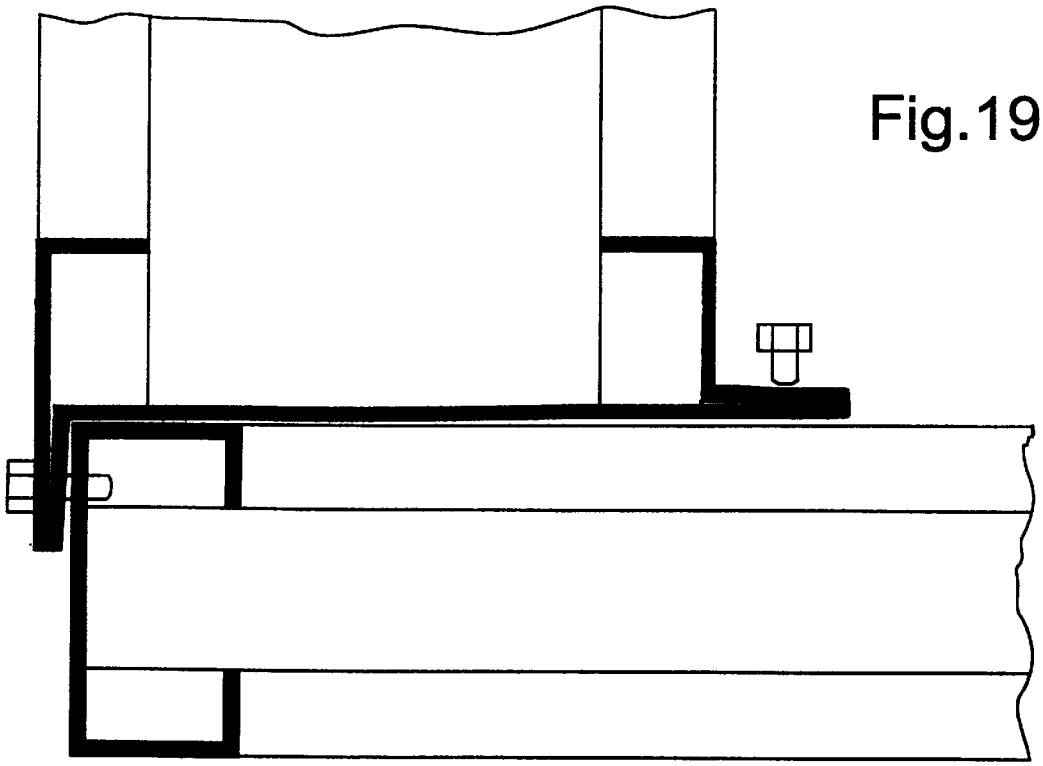
FIG. 19 is a plan view of a corner joint in such a structure.

In house building, see FIG. 18 as an example, the C-profiles will offer many different constructional possibilities, e.g. in corners, where the profiles may be screwed together or joined otherwise. As examplified by FIG. 19, special profiles may be shaped with projecting edge flanges for facilitating and stabilising such connections.

I claim:

1. A construction framework comprising intercrossing C-profiled beams of metal plate material, each of the beams having a base web and two opposed side webs; wherein each crossing comprises at least one first beam extending longitudinally in a first direction and at least one second beam extending longitudinally in a second direction which is perpendicular to both said first direction and a plane of the base web of the at least one first beam, said first beam, at the crossing, having an interruption in at least one of its side webs which connects with a recess in the base web for enabling lateral insertion of a crossing C-profiled second beam which is arranged so as to have a portion of one of its webs effectively filling the interruption of the side web of said first beam in the same plane as said at least one of said side webs.

2. The framework according to claim 1, further comprising connector elements being provided at each crossing for stabilizing the shape of the intercrossing beams.

3. The framework according to claim 1, wherein both of said first and second beams are provided with cutaway interruptions in one side web and a part of the base web such that the two beams are joinable by mutual lateral insertion into a configuration in which a non-interrupted side web of each beam fills out the interruption of the interrupted side web of the other beam.

4. The framework according to claim 1, wherein the first beam is provided with interruptions in both of its side webs at positions opposite each other and with a recess at each side of its base web adjoining each of the interruptions for accommodating a said second beam which is uninterrupted and inserted, at each side of the first beam, with the side webs of the second beam extending into the recess of the base web of the first beam and with the base web of the second beam filling out the interruption of the side web of the first beam.

5. The framework according to claim 4, wherein the second beams are anchored to the first beam by holding means.

6. The framework according to claim 1, wherein the web of the second beam a portion of which effectively fills the interruption of the side web of said first beam is the base web.

7. The framework according to claim 1, wherein the web of the second beam a portion of which effectively fills the interruption of the side web of said first beam is one of the side webs.

8. The framework according to claim 1, wherein at least one edge portion of the first beam defining the interruption is formed in part by a bent-away plate portion; and wherein the crossing second beam is secured to the bent-away plate portion.

9. The framework according to claim 8, wherein the bent-away plate portion is a bent-in plate portion.

10. A construction framework comprising intercrossing C-profiled beams of metal plate material, each of the beams having a base web and two opposed side webs; wherein each crossing comprises at least one first beam extending longitudinally in a first direction and at least one second beam extending longitudinally in a second direction which is perpendicular to both said first direction and a plane of the base web of the at least one first beam, said first beam having an interruption in at least one of its side webs at the crossing for enabling lateral insertion of a crossing second C-profiled beam which is arranged so as to have a wall means effectively filling the interruption of the side web of said first beam for stabilizing the open end of the interruption, said wall means extending across said interruption parallel to said at least one of said side webs of the first beam in said first direction.

11. The framework according to claim 10, wherein at least one of the second beams is arranged with outer edges of its side webs located adjacent to opposed ends of the interruption of the side web of the first beam in which it is inserted; and wherein said wall means comprises a filler plate arrangement provided inside the second beam with opposed edge portions thereof urged against inner sides of the outer edges of the side webs of the second beam.

12. The framework according to claim 11, wherein the filler plate arrangement comprises filler plates together with a tightening means for urging opposed edge portions of said filler plates against inner sides of the outer edges of the side webs of the second beam.

13. The framework according to claim 10, wherein said wall means comprises the base web of the crossing second beam.

14. The framework according to claim 10, wherein said wall means comprises a side web of the crossing second beam.

* * * * *